US005673446A

United States Patent [19]

Moen et al.

[11] Patent Number: 5,673,446

[45] Date of Patent: Oct. 7, 1997

[54] DEVICE TO ASSIST THE CHANGING OF A PILLOW CASE

[76] Inventors: Harold Moen, 215 Old Quarry Rd. N., Larkspur, Calif. 94939; Kenneth Tarlow, 94 Birch Ave., Corte Madera, Calif. 94925

[21] Appl. No.:

412,314

[22] Filed: Mar. 29, 1995

[51] Int. Cl.[6] ..... A47C 21/00

[52] U.S. Cl. ..... 5/489; 81/488

[58] Field of Search ..... 5/489, 488, 490, 5/636–658; 81/488

[56] References Cited

U.S. PATENT DOCUMENTS

| | | | |
|---|---|---|---|
| 359,617 | 3/1887 | Leonard | 5/489 |
| 1,140,583 | 5/1915 | Elliott | 5/489 |
| 1,712,711 | 5/1929 | Morgan et al. | 5/489 |

*Primary Examiner*—Alexander Grosz

[57] ABSTRACT

A device for holding a pillow in a convenient manner consisting of a pair of flexible poles connected at one end by a resilient rubber strip. At the other end a spring loaded retaining ball captures the pillow between the two poles. A second ball shaped handle is connected to an internal cable and when the ball is pulled it releases the retaining ball allowing the device to come out and the pillow staying in the pillow case.

6 Claims, 2 Drawing Sheets

DEVICE TO ASSIST THE CHANGING OF A PILLOW CASE

FIELD OF INVENTION

This invention provides particularly for holding a pillow in a convenient manner while drawing a pillow case into place.

PRIOR ART

Considerable time is lost in institutions such as hospitals and the like in inserting pillows into pillow cases,each of these operations occupying considerable time. Individuals at home also experience frustration at wrestling with a pillow while attempting to insert it into a pillow case. There have been a number of attempts in the past to remedy this problem. Charles Leonard,pat. no. 359,617 describes a pillow case holder which requires the user to sew loops to the corner of his pillow in order for the device to be used. Morgan and Hammer, pat. no. 1,712,711 describe a device for inserting pillows into pillow cases wherein a pair of flames the size of a standard pillow are used to capture the pillow. A loop portion on one frame engages a tang portion of the second frame. The frames can be disengaged by sliding one frame in front of the other allowing the pillow case to remain inside the pillow. The operation of this device appears to be rather awkward and the device is bulky therefore hard to transport and store. It also can not fit pillows that are smaller than the proposed frame. Doughterty,pat no. 1,743,329 describes a support for pillows which involves applying a permanent clip to the end of the pillow which engages a support board and allows the user to insert the pillow into the pillow case. All of the above inventions have certain limitations.Either they require the user to make certain custom additions to a standard pillow or, in the case of the Doughtery patent, appear to be awkward to use and can not be used for a small pillow.

BRIEF SUMMARY AND OBJECTS OF INVENTION

These disadvantages of the prior art are overcome with the present invention and an improved means for inserting a pillow case is provided which quickly and easily inserts a pillow into a pillow case without having to add any additional elements to the standard pillow.

These advantages of the present invention are preferably attained by providing an improved pillow inserting device which is comprised of two flexible hollow poles connected by an elastic strap. A series of springs,cables and retaining members located inside the hollow poles cause a pillow to be held securely between the two poles during insertion. The pillow can then be released from the poles by pulling on a knob located at the end of one of the poles situated at the exposed end of the pillow case.

Accordingly, it is an object of the present invention to provide an improved device for inserting pillows into pillow cases.

Another object of this invention is to provide an improved device for inserting pillows into pillow cases which can operate in a quick and easy manner.

An additional object of the present invention is to provide an improved device for inserting pillows into pillow cases so that no custom devices need to be added to the pillow to accomplish the goal.

A further object of this invention is to provide an improved device for inserting pillows into pillow cases which can be inexpensively manufactured.

A further object of the present invention is to provide an improved device for inserting pillows into pillow cases which is compact and can be easily carried and stored.

These and other objects and features of the present invention will be apparent from the following detailed description, taken with reference to the figures of the accompanying drawings.

DETAILED DESCRIPTION OF THE DRAWING

Figure 1:
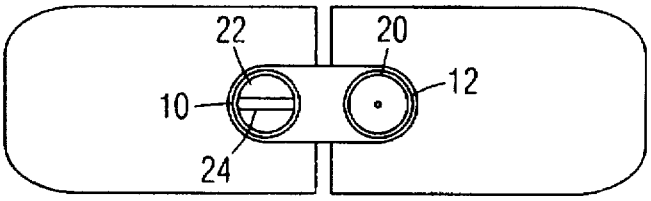
FIG. 1 is a top view of the present invention
Figure 2:
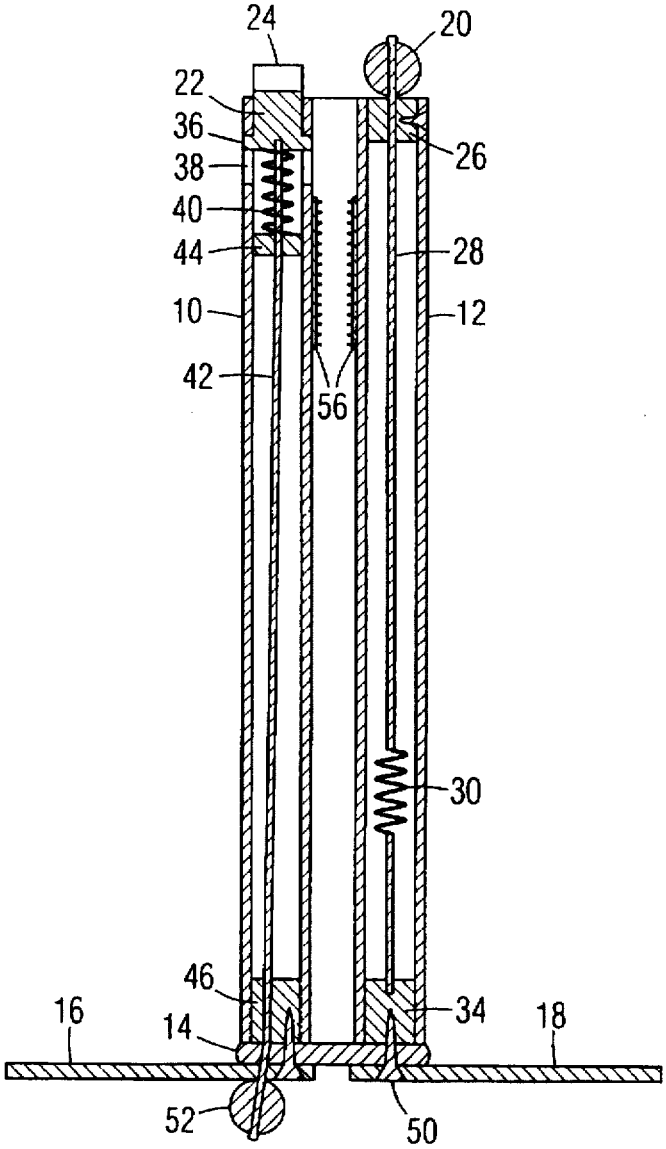
FIG. 2 is a front section view of the present invention

In the form of the present invention chosen for purposes of illustration, FIG. 1 shows a top view of the present invention. Retaining ball 20 is located at the top of hollow pole 12. Ball retaining plug 22 is located on top of pole 10. FIG. 2 shows a front section view which describes the construction of the device. Poles 10 and 12 are connected at the bottom by a flexible rubber strip 14. Cooperating hook and loop type fastener strips 56, are adhered to each pole in an inwardly facing direction. Plastic plates 16,18 are mated to rubber strip 14. Retaining ball 20 sits on top of stationary plug 26. Cable 28 is attached to retaining ball 20 and travels through stationary plug 26 and down the center of pole 12 where it is connected to spring 30 and finally connects to stationary plug 34. Sliding retaining plug 24 is located at the top of pole 10 and ear 36 protrudes through slot 38 to keep plug 24 from popping out of pole 10. Spring 40, rests on stationary plug 44 and pushes up on sliding plug 24. Cable 42 is attached to sliding plug 24 and travels down through spring 40 and through stationary plug 44 down through the bottom stationary plug 46, and through rubber strip 14 and finally through plastic plate 16 and ending in release ball 52.

Figure 3:
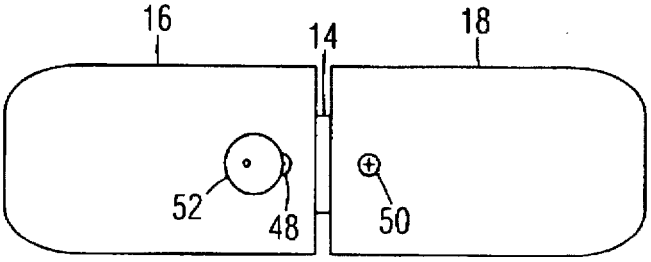
FIG. 3 is a bottom view of the present invention

FIG. 3 shows a bottom view of the present invention. Screws 48,50 hold plastic plates 16,18 and rubber strip 14 to bottom plugs 46 and 34 as shown in FIG. 2.

Figure 4:
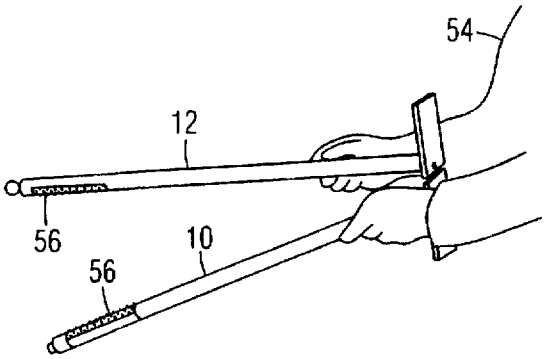
FIG. 4 is a perspective view of a person getting ready to insert a pillow into the present invention

FIG. 4 is a perspective view of a person 54, getting ready to put a pillow in the present invention. Poles 10 and 12 are spread and ready to receive a pillow.

Figure 5:
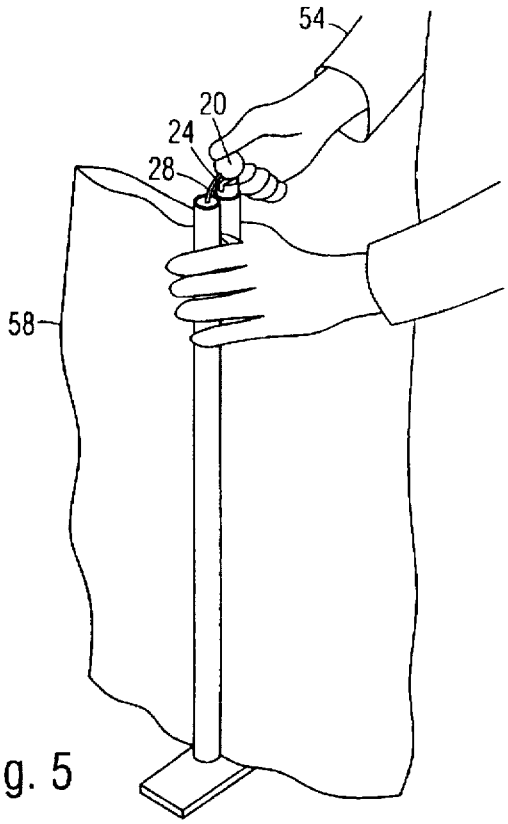
FIG. 5 is a perspective view of a person locking the retaining knob into position thereby securing the pillow.

FIG. 5 shows a perspective view of a person 54, locking the pillow 58, firmly in place by pulling retaining ball 20, and inserting cable 28 into slit 24 thereby locking the pillow securely into place.

Figure 6:
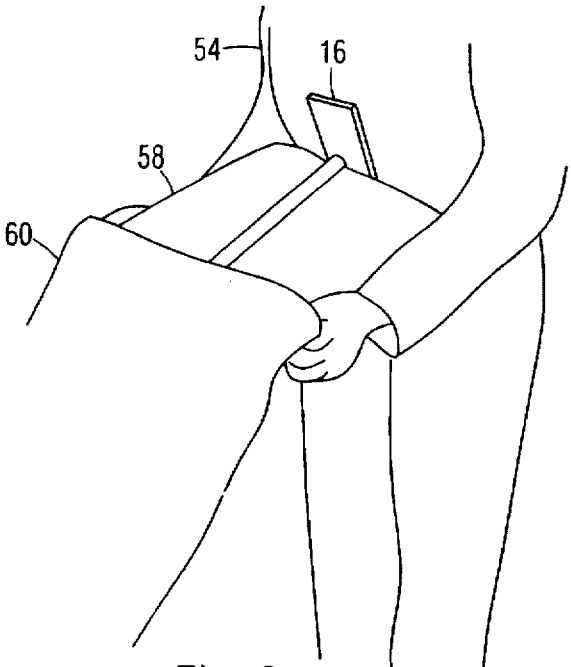
FIG. 6 is a perspective view of a person inserting a pillow into a pillow case using the present invention.

FIG. 6 shows a person 54, pushing the pillow 58, into pillow case 60. Plastic plate 16 helps spread the impact of the pulling force against the midsection of person 54.

Figure 7:
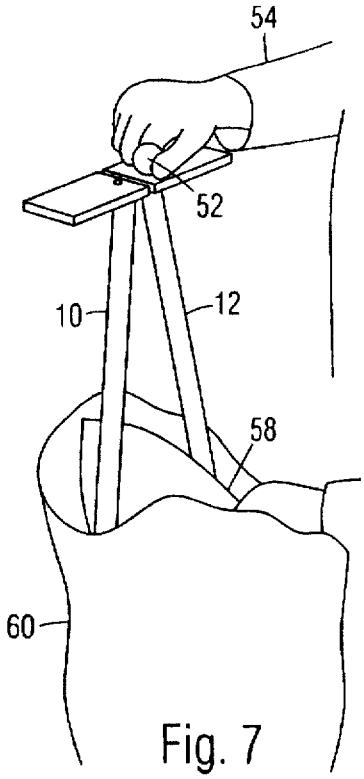
FIG. 7 is a perspective view of a person releasing the present invention from the pillow after it has been inserted into the pillow case.

FIG. 7 shows a person 54, releasing the poles 10,12 by pulling on release ball 52 causing poles 10 and 12 to separate at the enclosed end of the pillow case thereby allowing the person to completely remove the present invention leaving the pillows 58 completely inside the pillow case 60.

Obviously, numerous variations and modifications can be made without departing from the spirit of the present invention. Therefore, it should be clearly understood that the form of the present invention described above and shown in the figures of the accompanying drawing are illustrative only and are not intended to limit the scope of the present invention.

What is claimed is:

1. Means for suspending a pillow so as to have the hands free for drawing a pillow case into place comprising two hollow poles connected at one end by a resilient strip, one of said poles having a stationary plug at one end and a slidable plug at the other end which is pushed to an upwardly protruding position by a compression spring located directly beneath said slidable plug, a cable attached to the underside of said slidable plug which runs down the interior of said pole and exits said pole and also exits said resilient strip and also exits a plastic plate, ending at a ball shaped pull handle, the second said pole having a stationary plug at each end, a cable attached to one said plug,said cable traversing the length of said pole and being interrupted along said cable by a tension spring, said cable protruding out the top of said second pole and, ending in a ball shaped handle which can act as a retaining means, by being releasably secured to said slidable plug.

2. A means for suspending a pillow as claimed in claim 1 wherein said ball shaped handle which can act as a retaining means can be pulled by a person so that said cable which is attached to said retaining means can be placed in a slit which is located on the top surface of said slidable plug so that a pillow may be retained between the two said poles.

3. A means for suspending a pillow as claimed in claim 1 wherein said ball shaped pull handle can be pulled so that said attached cable pulls said slidable plug into said tube thereby disengaging said retaining ball and allowing said tubes to separate and thereby allowing said pillow which was trapped between said poles to remain in said pillow case.

4. A means for suspending a pillow as claimed in claim 1 wherein hook and loop type fastener strips are adhered to outside inner facing surfaces of said tubes to help hold said pillow in place.

5. A means for suspending a pillow as claimed in claim 1 wherein plastic plates, attached to said resilient strip, act to spread the incoming forces as a person pulls said pillow case onto said pillow.

6. A means for suspending a pillow as claimed in claim 1 wherein the entire construction is light in weight and compact for easy transport and storage.

* * * * *